US008415899B2

(12) United States Patent
Busse et al.

(10) Patent No.: US 8,415,899 B2
(45) Date of Patent: Apr. 9, 2013

(54) METHOD AND DEVICE FOR DETECTING A STATISTICAL CHARACTERISTIC OF A LIGHTING DEVICE

(75) Inventors: Olaf Busse, Munich (DE); Oskar Schallmoser, Ottobrunn (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 0 days.

(21) Appl. No.: 12/812,964

(22) PCT Filed: Jan. 17, 2008

(86) PCT No.: PCT/EP2008/050504

§ 371 (c)(1),
(2), (4) Date: Jul. 15, 2010

(87) PCT Pub. No.: WO2009/089910

PCT Pub. Date: Jul. 23, 2009

(65) Prior Publication Data

US 2011/0047337 A1 Feb. 24, 2011

(51) Int. Cl.
*H05B 37/02* (2006.01)

(52) U.S. Cl. ..... 315/307; 315/291; 315/186

(58) Field of Classification Search ..... 315/307, 315/291, 129, 133, 186, 209 R, 219, DIG. 4, 315/DIG. 7

See application file for complete search history.

(56) References Cited

U.S. PATENT DOCUMENTS

| | | | | |
|---|---|---|---|---|
| 3,964,059 | A * | 6/1976 | Morris | 377/27 |
| 7,397,707 | B2 * | 7/2008 | Mokhlesi | 365/185.33 |
| 7,633,406 | B2 * | 12/2009 | Miki | 340/9.1 |
| 8,174,200 | B2 * | 5/2012 | Kosaka et al. | 315/209 PZ |
| 2002/0113560 | A1 | 8/2002 | Edwards et al. | |
| 2007/0070692 | A1 | 3/2007 | Mokhlesi | |

FOREIGN PATENT DOCUMENTS

WO 0145471 A1 6/2001

OTHER PUBLICATIONS

English translation of International Search Report for PCT/EP2008/050504 mailed Nov. 12, 2008.

* cited by examiner

*Primary Examiner* — James H Cho

(57) ABSTRACT

A method for detecting a statistical characteristic of a lighting device is provided. The method may include a) generate a random number within a prescribable value range; b) compare the random number with a comparison number; c) c1) if the comparison of step b) yields a match: increase the count of a storage device by one step width.

11 Claims, 2 Drawing Sheets

METHOD AND DEVICE FOR DETECTING A STATISTICAL CHARACTERISTIC OF A LIGHTING DEVICE

RELATED APPLICATIONS

The present application is a national stage entry according to 35 U.S.C. §371 of PCT application No.: PCT/EP2008/050504 filed on Jan. 17, 2008.

TECHNICAL FIELD

Various embodiments relate to a method and a device for detecting a statistical characteristic of a lighting device.

BACKGROUND

Various embodiments relate in general to detecting statistical characteristics of a lighting device. These are to be understood, for example, as operating hours or switching-on processes of the lighting device. The reason for this measure resides in the fact that, for example, the light yield of LEDs depends strongly on ageing. By way of example, it is then possible to change the driving of the LEDs as a counter measure, depending on the detected operating hours. As regards defective returns, the number of operating hours or the number of switching-on processes is an important criterion in determining the cause of failure. In critical fields of application of lighting devices, for example OP luminaires, traffic lights, street lamps, maintenance intervals can be complied with after detection of the operating hours or the switching-on operations, it being possible thereby for failures of the lighting device that are fraught with consequences to be virtually completely prevented.

Different storage devices, for example flash memories, E2Proms, hard disks, etc are used in the prior art to detect such statistical characteristics. In this case, flash memories constitute the most advantageous variant, but are associated with the disadvantage that they cannot be written to as frequently as the other storage media. It is typically possible to write to flash memories up to approximately 50 000 times. E2Proms, which are, however, substantially more expensive than flash memories, offer the advantage that they permit up to 500 000 write cycles. On the one hand, as storage media hard disks require to be brought up to speed in order to carry out a write operation, something which is associated with time and energy requirement, and on the other hand are themselves expensive in small quantities.

The shorter the time unit that is to be detected is selected, for example hours or seconds, the more frequently the write cycles need to be carried out, and the more stringent the requirements placed on the selected storage medium. Moreover, there is also the problem that, as regards switching off the lighting device, the internal supply must be maintained for a sufficiently long time such that the characteristic can be secured. This is associated with the further disadvantage that large and therefore expensive buffer capacitors must be made available for supplying the components essential to the storage operation.

SUMMARY

Various embodiments provide a method and a device for detecting a statistical characteristic of a lighting device that enables the use of cost effective media, for example the use of flash memories.

Various embodiments are based on the finding that the required accuracy for such statistical characteristics of lighting devices is usually not particularly high. In general, a value of a few percent is perfectly sufficient. Consequently, it is possible not to carry out each write cycle, but to store only every tenth, hundredth or even thousandth cycle. Various embodiments are further based on the finding that this can be achieved without also counting when a random variable is used in order to determine whether a write cycle is or is not carried out this time. It is therefore possible to reduce the number of write cycles, the result at the end merely be scaled by a specific factor. This strategy furthermore enables the write cycles to be carried out even during the operation of the lighting device such that it is not dependent on any buffering of the voltage supply for the elements acting during the write operation.

Whereas the prior art provides a plurality of writable cells in a storage device such that, a transition is made from one cell to the next in order to prevent a failure after a prescribable number of write cycles, it is possible in the case of the present invention for the memories to be of small design, or to detect further reaching operating data, for example cycle type, temperature integral, etc.

A particular advantage of the present invention resides in the fact that despite a low number of write cycles it enables the detection even at very short operating times, for example 1 s or 10 s.

In the case of the inventive method the first step is to generate a random number within a prescribable value range, this being followed by a comparison of the random number with a comparison number. If this comparison yields a match, the count of a storage device is increased by one step width.

The comparison number is preferably a prescribable number from the value range from which the random number is generated.

Moreover, it is preferably provided, if the comparison step yields no match, to terminate the method without increasing the count of the storage device by one step width.

In the abovementioned preferred embodiments, the characteristic is preferably correlated with the switching-on processes of the lighting device, said steps being run through each time the lighting device is switched on.

In the case of another category of preferred embodiments, the comparison number can be correlated with the count of a time measuring device that is started when the lighting device is switched on. Here, the method in accordance with patent claim 1 preferably further includes the following steps: if the comparison step yields no match, the comparison step, in the case of which, after all, the comparison number changes continuously on the basis of the time detected by the time measuring device, is repeated until a match is achieved, the count of the storage device then being increased by one step width. If, however, the lighting device is switched off before a match is attained, the method is terminated.

It is particularly preferred in this case when, after the count of the storage device has been increased by one step width and the lighting device has not yet been switched off, a pause is made until the count of the time measuring device has reached the value that corresponds to the maximum value of the prescribable value range in the step of the generation of a random number, and subsequently the method continues with this generation step.

The count of the storage device is preferably continued each time after the lighting device is switched off so that the statistical characteristic of the lighting device can be detected over many switching-off operations. The step width by which the count of the storage device is increased is preferably 1.

An inventive device for detecting the statistical characteristic of a lighting device includes a device for generating a random number within a prescribable value range; a comparison device for comparing the random number with a comparison number; and a storage device that is coupled to the comparison device in such a way that if the comparison of the random number with the comparison number yields a match, the count of the storage device is increased by one step width.

The preferred embodiments, and their advantages, presented in conjunction with the inventive method are valid correspondingly, to the extent they can be applied, to the inventive device. In this case, corresponding devices are provided for each of the steps of the preferred embodiments of the inventive method.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
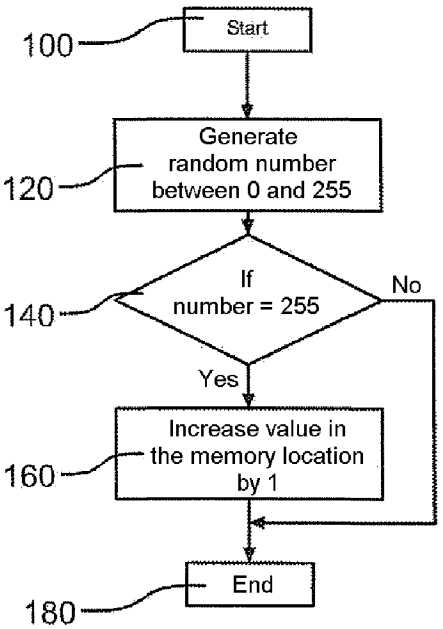
FIG. 1 is a schematic flowchart for a first exemplary embodiment of an inventive method.

FIG. 1 is a schematic flowchart for a first exemplary embodiment of an inventive method. The latter relates, by way of example, to the case when the aim is to detect the number of switching-on operations of a lighting device as characteristic. It begins in step 100 with switching on the lighting device. In step 120, a random number between 0 and a prescribable maximum value of a value range, here 255 (corresponding to $2^8$-1), is generated. If the comparison of the random number generated in step 120 with an arbitrary comparison number from the same value range yields a match, the value of a memory location of a storage device is increased by 1 in step 160. Subsequently, the method is terminated in step 180 independently of when the lighting device is switched off. If the comparison in step 140 yields no match, the method is likewise terminated in step 180 without increasing the value of the memory location.

Figure 2:
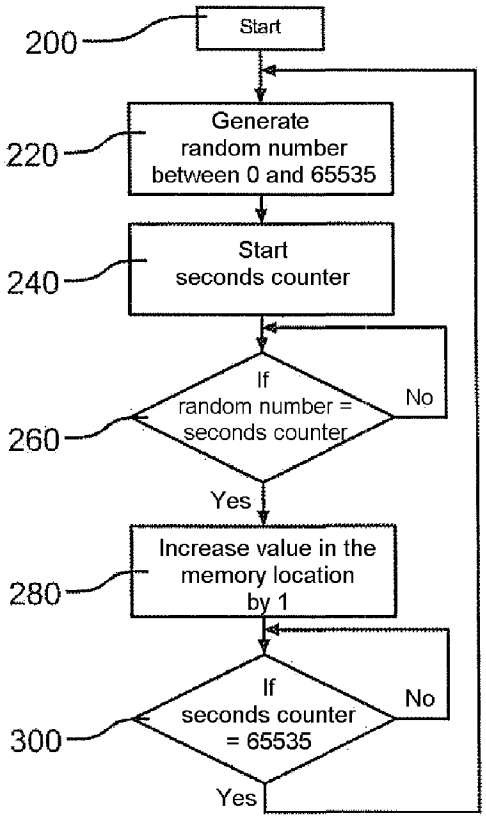
FIG. 2 is a schematic illustration of a flowchart for a second exemplary embodiment of an inventive method.

FIG. 2 is a schematic illustration of a flowchart for a second exemplary embodiment of an inventive method. This exemplary embodiment serves for detecting the operating time of a lighting device and serves, in particular, for implementing an operating seconds counter. It begins when the lighting device is switched on in step 200. In step 220, a random number is generated in a range between 0 and, presently, 65535 (corresponding to $2^{16}$-1). The maximum value of the value range can be fixed arbitrarily, but it determines the actual number of the write cycles executed. The larger this maximum number is selected, the smaller becomes the number of the write cycles actually carried out, as explained in yet more detail below. A seconds counter of a time measuring device is started in step 240. During the comparison carried out in step 260, the random number is compared with the current value of the seconds counter until a match is yielded. If this is the case, the value in a memory location of a storage device is increased by 1 in step 280. Subsequently, a pause is made in step 300 until the seconds counter has reached the maximum value of the prescribed value range, presently 65535. A return is then made to step 220, steps 220 to 300 being repeated until the lighting device is switched off. After the lighting device has been switched off, the method is started from the beginning, in particular independently of how far has already been counted in step 300. This entails that when the method is run through for the first time it is already terminated before a "yes" in step 260, or before the value "65536" is reached in step 300.

Figure 3:
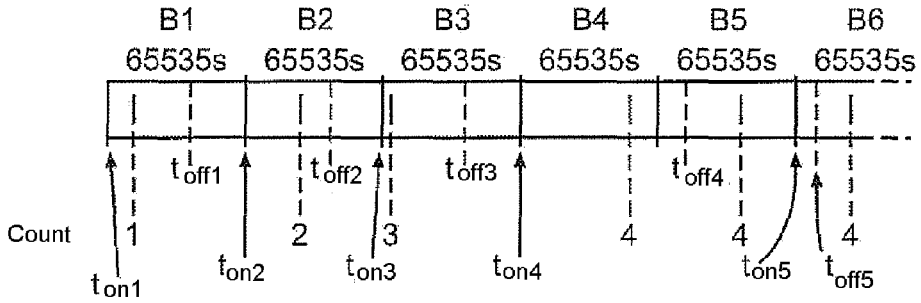
FIG. 3 shows a detail in the time domain for the exemplary embodiment of FIG. 2.

FIG. 3 shows the time profile of the method in accordance with the exemplary embodiment of FIG. 2. Blocks of a length of in each case 65535 s are juxtaposed here. A random number is entered schematically in each block Bi. Switching-off instants $t_{off1}$ are entered consecutively, in addition. In the block B1, the switching-off instant $t_{off1}$ lies after the instant prescribed by the random number, and so the count rises to 1 in the memory location. In the block B2, the switching-off instant $t_{off2}$ likewise lies, as does the switching-off instant $t_{off3}$ in the block B3, after the instant that is respectively prescribed by the random number generated in the respective step 220. This leads in each case to a further increase in the count. In the block B4, the lighting device is not switched off at all, but in fact the switching-off instant $t_{off4}$ already lies in the block B5. This leads to the increase in the count to the value 4 at the instant that is fixed by the random number generated for the block B4. In the block B5, the instant that is determined by the random number lies after the switching-off instant $t_{off4}$, and so the count is not increased. In the block B6, the switching-off instant $t_{off5}$ lies before the instant determined by the random number, and so the count continues to remain unchanged.

Figure 4:
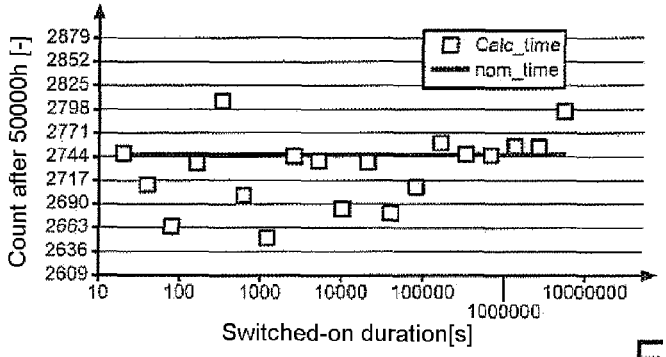
FIG. 4 shows the result of a computer simulation for the exemplary embodiment of FIG. 2.

FIG. 4 shows a schematic of the count of the storage device for an assumed operating time of 50 000 hours, a typical service life of an electronic ballast, for example of a lighting device, the 50 000 hours being composed of different switched-on durations of constant length. These different constant switched-on durations are given in FIG. 4 by the entries marked by squares. Switched-on durations of 20 s up to days are assumed in the illustration of FIG. 4. For reasons of simplicity in programming the simulation, the constant switched-on durations were respectively assumed. In accordance with the illustration of FIG. 3, the count is then increased by 1 if the random number generated in step 220 has already been reached, that is to say approximately every 65535 on average.

Thus, assuming the switching-on time is constant at 10 s, the entire operating period is 65535 s. The probability of increasing the count in the storage device by 1 is therefore 10: 65535=1: 6553. In other words, every 6553 blocks a hit is attained during comparison and leads to an increase in the count. If the switched-on duration of 10 s is now multiplied by the number 6553, this results in the correct number of operating seconds of 65530 s.

As shown in the example of FIG. 4, this therefore results in 2746.62 blocks from 50 000 hours at 3600 s each divided by the period of 65535 s of a block. As is to be gathered from FIG. 4, between 2650 and 2810 write cycles are carried out, depending on the switched-on duration selected. Given an operating seconds counter known from the prior art, which carries out a write operation every operating second, $180\times10^6$ write cycles would have to be carried out. In the case of the inventive method, by contrast, the operating seconds counter manages with a 1/65536 th of the write cycles. Nevertheless switched-on durations of a few seconds are also detected at the same time. The chart of FIG. 4 shows that the operating seconds are exactly correctly reproduced by up to approximately 3% by the inventive method.

Figure 5:
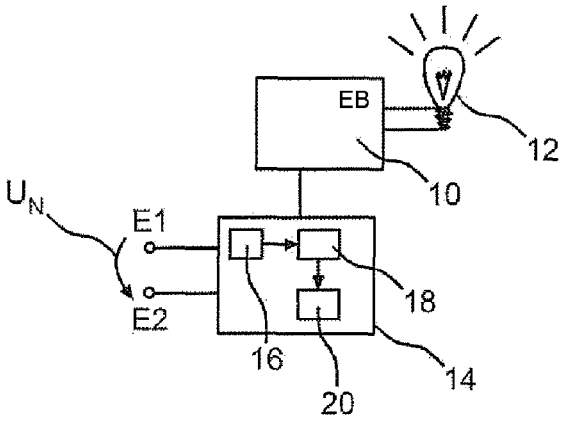
FIG. 5 is a schematic of an exemplary embodiment of an inventive device.

FIG. 5 shows a schematic of the design of an inventive device. The latter has an input with a first input connection E1 and a second input connection E2, to which connections a system voltage $U_N$ is applied.

It includes an electronic ballast 10 to whose output an illumination means 12 is coupled. An inventive device 14 is coupled between the input connections E1, E2 and the electronic ballast 10. This device has a device 16 for generating a random number within a prescribable value range. It further includes a comparison device 18, coupled to the generation for comparing the random number with a prescribable comparison number. A storage device 20 is coupled to the comparison device 18, specifically in such a way that the count of the storage device 20 is increased by a step width if the comparison of the random number with the comparison number yields a match.

As is evident to the person skilled in the art, the inventive device can also be provided at another site than illustrated in FIG. 5. Thus, by way of example it can, in particular, be accommodated in the electronic ballast 10. Furthermore, an inventive device can be designed to detect a plurality of statistical characteristics of a lighting device, that is to say, by way of example, the number of the switching-on operations and the operating period, it being possible for these variables to be detected for different elements of the lighting device. In the case of the exemplary embodiment of FIG. 5, it is therefore possible to detect the statistical characteristics separately for the electronic ballast 10 and the illumination means 12 which, after all, can be different after replacement of one of the two in the case of a defect or maintenance.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for detecting a statistical characteristic of a lighting device, the method comprising the following steps:

a) generate a random number within a prescribable value range;

b) compare the random number with a comparison number;

c) c1) if the comparison of step b) yields a match:
increase the count of a storage device by one step width;

wherein the characteristic is correlated with the switching-on processes of the lighting device, the steps a) to c) being run through each time the lighting device is switched on.

2. The method as claimed in claim 1,
wherein the comparison number is a prescribable number from the value range of step a).

3. The method as claimed in claim 2,
wherein the step c) further comprises:
c2) if the comparison of step b) yields no match:
terminate the method without increasing the count of the storage device by one step width.

4. The method as claimed in claim 1,
wherein the count of the storage device is continued each time after the lighting device is switched off.

5. The method as claimed in claim 1,
wherein the step width is 1.

6. A method for detecting a statistical characteristic of a lighting device, the method comprising the following steps:

a) generate a random number within a prescribable value range;

b) compare the random number with a comparison number, wherein the comparison number is correlated with the count of a time measuring device that is started when the lighting device is switched on;

c) c1) if the comparison of step b) yields a match:
increase the count of a storage device by one step width.

7. The method as claimed in claim 6,
wherein the method further comprises:
c2) if the comparison of step b) yields no match:
repeat step b) until a match is achieved, and then continue with step c1); or
c3) if the lighting device is switched off in step c2) before a match is attained:
terminate the method.

8. The method as claimed in claim 7,
wherein the following step is executed after step c2):
d) wait until the count of the time measuring device has reached the value that corresponds to the maximum value of the prescribable value range of step a); and continue the method with step a).

9. The method as claimed in claim 6,
wherein the count of the storage device is continued each time after the lighting device is switched off.

10. The method as claimed in claim 6,
wherein the step width is 1.

11. A device for detecting a statistical characteristic of a lighting device, the device comprising:

a device for generating a random number within a prescribable value range;

a comparison device for comparing the random number with a comparison number, wherein the comparison number is correlated with the count of a time measuring device that is started when the lighting device is switched on; and a storage device that is coupled to the comparison device in such a way that if the comparison of the random number with the comparison number yields a match, the count of the storage device is increased by one step width.

* * * * *